United States Patent [19]

Fischer

[11] 4,417,516

[45] Nov. 29, 1983

[54] ROTARY PRINTING MACHINE SYSTEM

[75] Inventor: Hermann Fischer, Augsburg, Fed. Rep. of Germany

[73] Assignee: M.A.N.-Roland Druckmaschinen Aktiengesellschaft, Offenbach am Main, Fed. Rep. of Germany

[21] Appl. No.: 372,999

[22] Filed: Apr. 29, 1982

[30] Foreign Application Priority Data

May 15, 1981 [DE] Fed. Rep. of Germany ..... 3119398

[51] Int. Cl.[3] ..... B41F 11/00; B41F 5/14

[52] U.S. Cl. ..... 101/181; 101/228; 226/195; 242/75.3

[58] Field of Search ..... 101/181, 177, 228, DIG. 28; 226/195; 242/75.3

[56] References Cited

U.S. PATENT DOCUMENTS

| | | | |
|---|---|---|---|
| 2,066,306 | 12/1936 | Horton | 242/75.3 |
| 2,569,264 | 9/1951 | Stone et al. | 242/75.3 |
| 2,979,280 | 4/1961 | Ralph | 242/75.3 |
| 3,025,791 | 3/1962 | Auerbacher | 101/181 |
| 3,072,050 | 1/1963 | Wolff | 101/DIG. 28 |
| 3,169,422 | 2/1965 | Sims et al. | 242/75.3 |
| 3,335,928 | 8/1967 | Angell | 242/75.3 |
| 3,808,971 | 5/1974 | Staamann | 101/181 |
| 4,050,642 | 9/1977 | Katsumata et al. | 242/75.3 |
| 4,124,156 | 11/1978 | Waffner | 226/195 |
| 4,280,406 | 7/1981 | Corse | 101/177 |

*Primary Examiner*—William Pieprz

*Attorney, Agent, or Firm*—Frishauf, Holtz, Goodman, Woodward

[57] ABSTRACT

To permit compensation and guidance for different paths (A, B) of a paper web through a printing machine, for example, selectively, for offset lithographic printing, di-lithographic printing, or flexo printing, a paper deflection roller is positionable between two base or fixed positions (A, B) in dependence on the selected printing mode and hence paper path, and, additionally, in a superimposed movement, deflectable to control the paper tension between adjacent printing stations (1, 2, 3, 4) so that tension between printing stations of the web can be individually controlled and maintained at a suitable level, applicable also to low-strength paper, such as recycled paper. Positioning of the deflection roller for different modes of operation can be carried out, for example, by shifting the position of the deflection roller by means of a stepping motor; fine positioning of the deflection roller to compensate for paper tension can be accomplished, for example, by additionally stepping the stepping motor through only few steps in comparison to change of base position, or by an additional piston-cylinder assembly, moving the deflection roller in accordance with preprogrammed or predetermined stop positions selected, by experience, based on the particular type and characteristics of the paper used and the printing mode.

9 Claims, 6 Drawing Figures

ROTARY PRINTING MACHINE SYSTEM

Reference to related application, assigned to the assignee of the present application: U.S. Ser. No. 369,883, filed Apr. 19, 1982, by the inventor hereof, entitled "Rotary Printing Machine System", Swiss Pat. No. 521,232.

The present invention relates to a rotary printing machine, and more particularly to a printing machine having paired rubber blanket—plate cylinders, arranged in printing stations adapted to be passed sequentially by a web of substrate, typically paper.

BACKGROUND

A rotary printing machine of the type in which a plurality of printing stations are sequentially passed by a web of paper, and which, additionally, has a mechanism to adjust the length of the path of the web of paper between sequential printing stations, is described in Swiss Pat. No. 521,232. In this known machine, the web of substrate is carried over register rollers positioned between neighboring printing stations. The register rollers permit compensation for variations in distance traveled by any specific area of the web between the printing stations in order to maintain register. The compensating rollers, thus, permit compensation for different paths of the web within the various printing stations. Separate guide rollers are used in order to generate the required web tension. The reference is silent, however, regarding the means and ways in which the deflection and web tensioning rollers are to be controlled or adjusted.

THE INVENTION

It is an object to provide an arrangement to control the path of a web between adjacent printing stations and compensates for different paths; and, additionally, to control the web tension between adjacent printing stations to permit individual tensioning adjustment which can be preset or preprogrammed, so that optimum web tension can be controlled in dependence on the type and quality of the printing substrate in all the sections between neighboring printing stations.

Briefly, deflection elements such as rollers are located between the sequential printing station in order to provide predetermined tension between the stations when the printing system is engaged with the substrate web. The deflection rollers are movable in accordance with a first adjustment arrangement to provide for guidance of the web in a given selected path, which may vary between adjacent printing stations in accordance with the type of printing effected by the adjacent or neighboring printing stations. Superimposed on that movement is a further control effect, for example by additional movement of the roller, or by providing a force against the web, for example formed by a compressed air blast or the like, to adjust the tension of the web between the adjacent printing stations. The second superimposed application of force, by movement or air pressure, is preferably controlled by preset, programmable control elements which can be individually adjusted and programmed or matched to the type of paper of the substrate used. For example, low-quality newsprint is subject to tearing under high-tension conditions; recycled paper, likewise, has lower tensile strength than prime-quality printing stock. The system thus permits maintaining of tension between sequential printing stations as a paper web is being printed upon, without overstressing the paper web being introduced to the first printing station. The tension between the neighboring printing stations, thus, can be accurately controlled to match the quality and characteristics of the particular substrate used, and preset, so that, upon release of printing tension, for example upon threading of web therethrough, and subsequent engagement of printing information and impression cylinders which, for example, may be oppositely located blanket cylinders of an offset, di-litho, or flexo printing system, the tension previously determined will be reestablished and thus obviate laborious recalibration of match of the tension to the particular web of paper being used in the printing machine.

DRAWINGS

Figure 1:
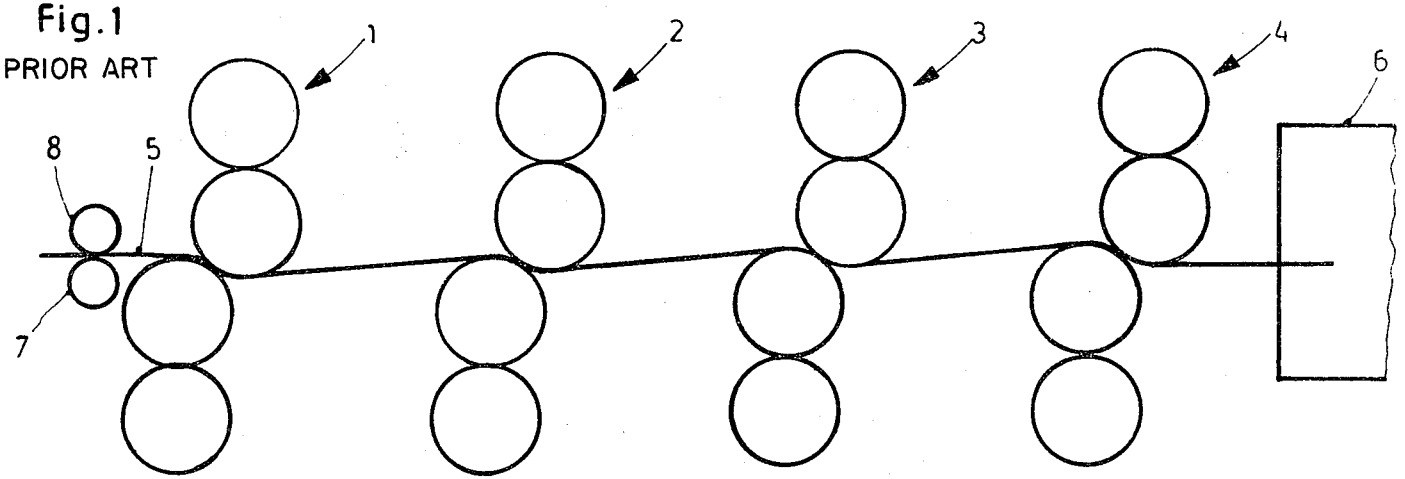
Fig.1 PRIOR ART
FIG. 1 is a schematic side view of a multiple printing station printing machine in accordance with the prior art.

A multiple printing station rotary printing machine in serial construction for prime and verso printing is shown in FIG. 1. The machine has four stations 1, 2, 3, 4. A paper web 5 is passed from a position between starting tension rollers 7, 8 through the serially arranged printing stations, where the initially dry paper web is inked for printing, for example, on both sides of the paper in four colors. The printed papers is then guided to a dryer 6, which may be of any suitable and standard construction, for subsequent folding, cutting, and handling as desired, and well known. The tension rollers 7, 8 so control the tension of the inlet portion of the web that the printing stations downstream of the first printing station 1 and the subsequent dryer will pull the paper through with a predetermined minimum tension $S_{min}$. The paper tension drops as the paper passes through the serially arranged printing stations. The term "downstream" as used herein, of course, refers to the travel of the web of paper, or any incremental area thereof, through the sequentially arranged stations 1, 2, 3, 4.

Figure 2:
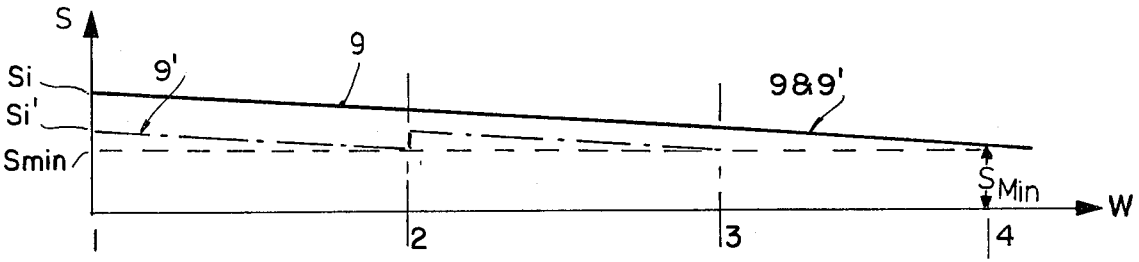
FIG. 2 is a diagram of web tension (S) with respect to the path distance from a base line by any incremental area of the web, on the abscissa W.

The paper tension must be so adjusted by the tensioning rollers 7, 8 that, in spite of the drop of tension between adjacent printing stations, the remaining minimum tension at the last printing station 4 is still present to permit pulling the paper through the dryer, and such other equipment as may be connected serially thereto. The diagram in accordance with FIG. 2 illustrates the drop in paper tension, in which the ordinate is representative of tension S, and the abscissa is representative of the path length through the various printing stations. The paper tension illustrated by graph 9 drops, as can readily be seen, from station to station.

When using paper of low tensile strength, for example recycled paper, high initial tensions at the first printing station, or in advance thereof, may lead to tearing of the paper web 5.

In accordance with the present invention, and as described in greater detail in connection with the subsequent figures, web deflection elements are provided in which not only differences in paper paths between neighboring printing stations can be compensated, but additionally individual adjustment of the paper tension between the respective serially arranged printing stations can be insured, in spite of variations in characteristics of paper.

Figure 3:
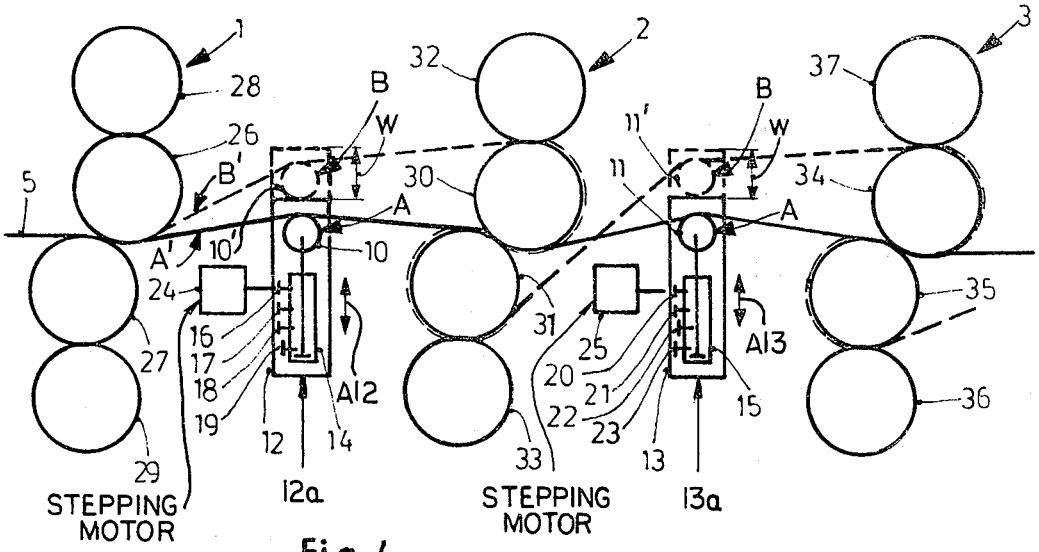
FIG. 3 is a fragmentary side view of a multiple printing station printing machine for prime and verso printing with a web deflection device in accordance with the present invention.

In accordance with a feature of the invention, and as illustrated in FIG. 3, a web deflection roller 10 is positioned between the printing stations 1 and 2. A further web deflection roller 11 is located between the printing stations 2, 3. If further printing stations are used in the system, additional similar deflection rollers may be used. The deflection rollers 10, 11 are secured on a slide 12, 13, respectively, and positioned transversely to the transport direction of the paper web 5. The sliding movement of the slide is indicated by the double arrow A12, A13. The slides 12, 13 are moved up-and-down by suitable and well known operating elements, as schematically indicated by arrows 12*a*, 13*a*, respectively. The arrows represent such well known structural elements as, for example, a rack secured to the slides 12, 13, engaged by a pinion connected to an electric or a fluid motor; a hydraulic or compressed-air piston-cylinder arrangement, or any other suitable motion-transmitting element, including manually adjustable levers which can move the slides 12, 13 back-and-forth in the direction of the arrows A12,A13, respectively.

In accordance with a further feature of the invention, additional means are provided on the slides 12, 13, respectively, in order to shift the position of the rollers 10, 11 on the slides themselves. These additional means may, for example, be formed by piston-cylinder assemblies 14, 15 located on the slides 12, 13, respectively. Thus, the slides can be moved with two superimposed motions: The motion controlled by the slide positioning elements 12*a*, 13*a* themselves and, in addition thereto, the motion controlled by the piston-cylinder assemblies 14, 15 on the slides. Piston-cylinder assemblies 14, 15 usually will have lesser travel distance than the distance to which the slide itself can travel, as indicated by arrows A12, A13.

In accordance with another, and preferred, feature of the invention, the distance of travel of the piston within the cylinder of the piston-cylinder assemblies 14, 15 is controllable by limit-control screws 16–19, which limit or control the distance of the stroke of the piston within the piston-cylinder arrangement. Similarly, control screws 20–23 are provided for the piston-cylinder assembly 15 of the slide 13. The particular deflection limit through which the web deflection roller 10, 11 can move when the piston-cylinder arrangement 14, 15, respectively, has pressure fluid applied thereto can thus be preset and preprogrammed. The distance can be set either manually or automatically, for example by positioning motors which can be externally programmed, for example stepping motors.

A simple way of shifting the slides 12, 13 is to do so manually; if automatic operation, for example to predetermined positions, is desired, a stepping motor 24, 25, respectively, may be coupled to the slide to shift the slides by predetermined stepping distances.

The stepping motor 24, 25, respectively, then will form the drive elements schematically indicated by the arrows 12*a*, 13*a*.

The printing station of FIG. 3 is constructed, for example, for offset printing and has two blanket cylinders 26, 27 which have plate cylinders 28, 29 associated therewith. Inkers and dampers have been omitted from the drawing for clarity. The second printing station 2 likewise has two rubber blanket cylinders 30, 31 and plate cylinders 32, 33. The printing station 3 likewise has paired plate and rubber cylinders 37, 34 and 36, 35. Station four and possible further printing stations have been omitted from the drawing for clarity.

Operation: Let it be assumed that the web is passed through the printing stations 1, 2, 3 as shown in solid lines, that is, in path A'. In this mode, multi-color prime and verso printing is possible. The deflection rollers 10, 11 are placed in a position shown in full lines in FIG. 3. The full-line position is obtained by so controlling the stepping motors 24, 25, by previous program, for example, or manual operation, that the paper web is deflected from a straight-line path between the printing stations 1, 2. Similarly, roller 11 is controlled to deflect the paper web from a straight-line path between the printing stations 2, 3. The deflection is controlled in dependence on the desired paper tension which, in turn, will depend on paper quality and characteristics.

Initially, the deflection rollers 10, 11 are so positioned that, with the blanket cylinders 26, 27; 30, 31; 34, 35 engaged, the paper path 5 is slightly deflected from a straight-line position, as shown in FIG. 3. The machine is then stopped, and the blanket cylinders 26, 27; 30, 31; 34, 35 are brought out of engagement. The stepping motors 24, 25, or equivalent operating elements, are then retracted slightly, thus reducing the tension on the web, for example to form an essentially straight-line path of the web 5 between adjacent printing stations. The tension rollers 7, 8 (see FIG. 1), which are also provided in the structure of FIG. 3, as well as the rollers of the dryer 6 (FIG. 1), or other subsequent apparatus, which may be two gripping rollers, a folder, or other structures, are then adjusted so that the tension on the web will be uniform throughout the length of the machine from the input rollers 7, 8 to the output apparatus, for example the dryer 6. The rubber blanket cylinders are then brought together, so that the paper web is pinched or clamped between the rubber blanket cylinder pairs 26, 27; 30, 31; 34, 35. This pinching effect can also be obtained by circumferentially offsetting the blanket cylinders, so that the grooves of the blanket cylinders do not meet each other. The slides 12, 13, respectively, then are moved to the preprogrammed base position A which is associated with the path of the web A' for offset printing.

In addition to the basic movement imparted to the slides basically shown by the arrows 12*a*, 13*a*, or by the stepping motors 24, 25, respectively, additional fine adjustment of the position of the rollers 10, 11 can be obtained by superimposing an adjustment path controlled by providing pressure fluid to the piston-cylinder arrangements 14, 15 and controlling the position of the rollers 10, 11 in accordance with a predetermined positioning pin or set screw 16–19, or 20–23, respectively. The additional, superimposed positioning movement is preferably empirically determined. The set pins or screws 16–19, 20–23, respectively, can be preprogrammed for individual positioning dependent on paper quality or characteristics, for example such that the desired web tension will obtain between the respective printing stations. This, then, permits high-speed operations, even with paper of low tensile strength or low quality, and reliably preventing tearing of the paper web.

The deflection rollers 10, 11 have the combined function of controlling the position of the paper web while, additionally, permitting adjustment of the tension of the paper web, individually between the respective printing stations in dependence on paper quality, in order to compensate for drop in tension between the printing stations. The adjustment position obtained by the piston-cylinder assemblies 14, 15, or otherwise obtainable superimposed movements, can be preprogrammed. Additionally, register can be maintained with respect to different paths of the paper web. FIG. 3 illustrates, in broken lines, a path of the paper web B' which permits a different mode of printing. If it is desired to conduct the paper according to the path B', the slider moving apparatus 12*a*, 13*a*, for example the stepping motors 24, 25, are controlled to move the roller 10, 11, respectively, to the position shown at B. Fine adjustment of the register, in the order of 3 to 4 millimeters, for example, can be obtained by rotation of the respective cylinders. An easy way of effecting this adjustment is to use spiral gears and axially shifting the printing cylinders which, then, likewise induces sliding rotation thereof.

In accordance with a feature of the invention, the printing machine may be selectively operated in direct lithographic printing (di-litho printing) or flexo printing, for example. For the alternate mode of printing, the paper web is guided in the path B'. As illustrated, printing station 1 can operate, as before, in the offset mode. The paper web 5 is then passed, as seen in broken lines, in S-shape, about the blanket cylinders 30 and 31 and, again, about the blanket cylinders 34, 35 of printing station 3. The printing stations 2, 3 then can operate either in di-litho, or flexo printing mode. Change-over is readily possible by use of the web deflection elements as described, for example by merely pressing an operating button controlling stepping of the stepping motor to step for the required number of steps to move the slide associated therewith for the required distance and shift the position of deflection roller 10, 11, respectively, from A to B.

Initially, the slides 12, 13 are moved upwardly by the stepping motors 24, 25 by a predetermined distance W, so that the rollers 10, 11 will be moved in the broken-line position 10', 11'. The required compensation, for rough register maintenance, is thus obtained. Individual adjustment of the path of the paper web under the then pertaining conditions can be obtained by moving the roller for a further distance in accordance with the then active position limit pins or screws 16–19 and 20–23. The position limit screws 16–19 and 20–23 can be automatically operated, for example by positioning motors, from a programming or control panel, by solenoids individually activating the respective positioning pins, or the like, so that for any type of printing mode individual control of the path of the paper web as well as of the tension between neighboring printing stations can be predetermined, programmed, or noted on an instruction panel, and reproducibly applied to the paper web.

As previously described in connection with offset printing, paper web tension can be released when the respective printing cylinders are brought out of engagement with respect to each other. Unloading of tension or reduction of tension can be obtained by, for example, moving the slides 12, 13 downwardly for at least a fraction of their entire moving distance by suitable energization of the stepping motors 24, 25.

The deflection system thus permits changing of the path of the paper web, and to provide for initial tension of the paper web by proper control and energization of the stepping motors 24, 25. This can be done before printing is effected by the printing stations 1–3, that is, while the paper web is dry. When the paper web has print applied thereto, that is, when it is wetted by ink, the base positions A and B, have superimposed thereon the tensioning movement which can be determined empirically. The additional deflection paths superimposed on the base positions are determined in by the characteristics of the paper web, the ink, and the like. The deflection between the first printing stations 1 and 2 will, usually, be larger than the deflection between subsequent printing stations, since, usually, the paper web is longer between the first and the second printing stations than between the second and subsequent printing stations.

The deflection element, thus, can be controlled in accordance with two different criteria: One is paper path, that is, printing mode desired, and the other is tension on the paper which, in turn, depends on a number of parameters, which include paper quality and characteristics, type of inking, and the like.

Figure 4:
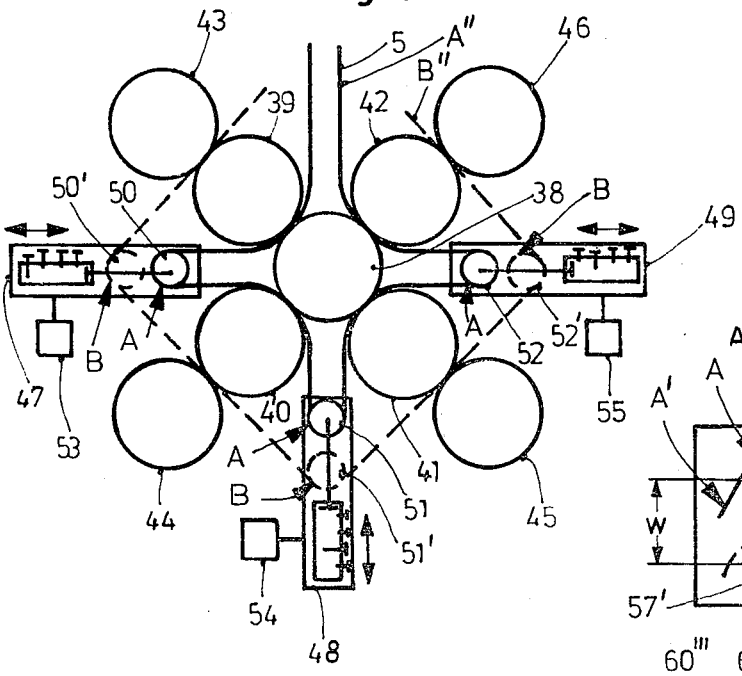
FIG. 4 is a schematic side view of a printing machine with multiple printing stations in a compound arrangement.

Embodiment of FIG. 4: Basically, FIG. 4 illustrates the invention in combination with a satellite printing machine. This machine has a central impression cylinder 38 on which four rubber blanket cylinders 39, 40, 41, 42 can be applied, located, respectively, in star-shaped arrangement with respect to the central impression or printing cylinder 38. Each one of the rubber blanket cylinders 39–42 is paired with a respective plate cylinder 43, 44, 45, 46. As before, inkers and dampers have been omitted for clarity, and may be of any suitable and conventional construction.

A deflection structure is located between adjacent rubber blanket/plate cylinder pairs. The construction of the deflection structure or system is identical to that described in connection with the printing machine of FIG. 3. Sliders 47, 48, 49 are provided. No slider is needed between the cylinder pairs 42, 46 and 39, 43 since this is the place in which the paper web 5 is introduced into the printing station and removed therefrom. Deflection rollers 50, 51, 52, corresponding to the deflection rollers 10, 11 of FIG. 3, are provided, each one being individually movable by pistons, not further specifically numbered or referred to, similar to the arrangement of FIG. 3

The machine of FIG. 4 can be operated in offset mode, and the paper web 5 is then guided as shown by the solid-line path A", that is, the solid-line path of paper web 5. The deflection rollers 50, 51, 52 will be in their base position A. If the paper web is to be guided in the path shown by the broken-line path B", the rollers will be in the broken-line position 50', 51', 52', that is, at the second base position B. The fixed or base positions A and B are provided for the respective paths A", B" of the paper web 5. Superimposed on the shift of position of the rollers between the base positions A and B is an additional, individually controllable movement to permit adjustment of the web tension between the respective cylinder pairs. If the paper web 5 is guided along the path B" shown in broken lines, the printing machine in accordance with FIG. 4 can operate in the di-litho or in flexo mode of printing.

Figure 5:
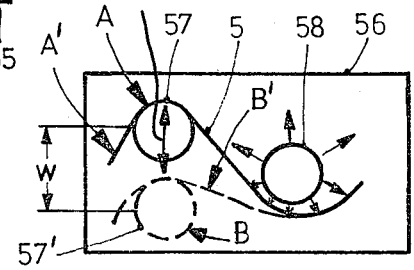
FIG. 5 is a fragmentary side view of another web deflection system suitable in the machine of FIG. 3 or 4.
Figure 6:
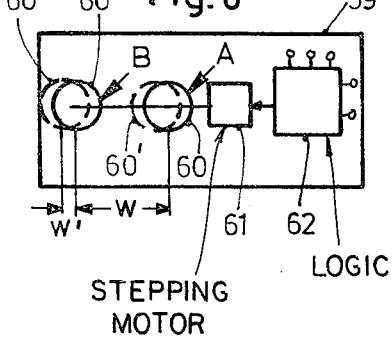
FIG. 6 is a fragmentary side view of another type of deflection arrangement suitable in the machine of FIG. 3 or 4, for example.

The deflection units can be of various types and structures. FIGS. 5 and 6 illustrate alternative embodiments. It is not necessary that the deflecting movement be linear. As seen in FIG. 5, a fixed holder, for example in form of a plate 56, is provided. Plate 56 can be located, for example, for use in the embodiment of the invention of FIG. 3 or 4 at two sides of the printing cylinders, for example at the side walls of the printing machine. Such side walls are customarily provided. Separate brackets or holders secured to the printing machine also may be used. The fixed roller 58 is constructed in form of a compressed-air roller which has nozzles extending circumferentially therefrom. A movable roller 57 is likewise positioned on the holder 56. The roller 57 can be moved from the solid-line position to the broken-line position illustrated at 57', that is, along the path of the arrow A57. One of the positions, for example base position A, can be associated with offset printing mode of operation of the machine; the other position, for example base position B in which the roller is shown at 57', can be associated with a web path for di-litho or flexo printing. The superimposed movement of the web is obtained by providing compressed air to the compressed-air roller 58, the pressure of the compressed air being changed in accordance with tensioning requirements, and different pressures corresponding, functionally, to the different position settings obtained by the positioning pins 16–19 and 20–23, respectively, of FIG. 3. Thus, an additional deflecting force is applied to the paper web 5, superimposed on the deflecting movement as illustrated by arrow A57.

The deflection unit of FIG. 6 utilizes a pair of fixed holders 59 located at either facing end of the printing cylinders, on which a deflection roller 60 is slidably retained. The deflection roller 60 can be placed by a stepping motor 61 in respective position 60', 60'', 60'''. The stepping motor 61 is controlled by a programmable control or logic circuit 62 which, for example, may be a microprocessor. The deflection roller 60 may have two base positions; A, for example for offset printing, and B, for example, for flexo printing. The base position A as well as the base position B can have an additional positioning path superimposed thereon, illustrated by the path W', which can shift the roller from solid-line position 60 to broken-line position 60', and solid-line position 60'' to broken-line 60''', corresponding, respectively, to the base positions A and B. For example, the base positions A and B are obtained by so controlling the stepping motor 61 that, to move the roller from the position A to B, the motor has to step twelve times; the superimposed position, from 60 to 60' or 60'' to 60''', respectively, is individually adjustable by a few steps, for example one or two or three only.

Additionally flexibility can be obtained by constructing the deflection rollers as double rollers between which the paper web 5 is threaded, so that the paper web can be deflected upwardly, as shown in FIG. 3, or downwardly, for example to direct the paper web from between the rubber blanket rollers 26, 27 to the nip between the rollers 33, 31 of FIG. 3, respectively, and then in S-shape upwardly, that is, the up-down mirror image path as illustrated in FIG. 3.

The roller 58 (FIG. 5) can be rotatable or can be formed as an air blast nozzle tube which is fixed, and which has air blast nozzles directed to the web to apply a deflecting force thereto in dependence on the selected air pressure, in order to compensate for changes in web tension between neighboring printing stations.

Various changes and modifications may be made, and features described in connection with any one of the embodiments may be used with any of the others, within the scope of the inventive concept.

FIG. 2 shows the improvement obtained by the present invention in graphic terms. The abscissa is subdivided by showing, schematically, the location at the various printing stations. In accordance with the prior art, an initial tension $S_i$ has to be set into the machine system, the tension dropping in accordance with the solid-line curve 9. The system in accordance with the present invention, however, requires a substantially lower initial tension, which may be the equivalent of the minimum tension $S_{min}$, the tension being raised to the required tension between stations $S_i'$ by the deflection roller, and specifically by the excursion controlled by the piston-cylinder assemblies 14, 15 (FIG. 3) or by a few steps of the stepping motor 61 under control of the logic 62 (FIG. 6) or by the air pressure by the air pressure supplying roller or nozzle tube 58 (FIG. 5). The maximum tension applied to the web, thus, is only slightly above that of the minimum required tension since each one of the deflection rollers, or the nozzle 58, need apply a deflecting force to the paper web 5 between the stations only to the extent of the tension drop between the stations.

I claim:

1. Rotary printing machine system having at least two printing stations (1, 2, 3, 4) for sequential printing on a web (5) of substrate, guided from one station (1, 2, 3) to the next neighboring station (2, 3, 4)

said printing stations being operative in selected different printing modes resulting in different operating conditions of the printing stations and requiring different length web paths through said stations;

each station having at least one paired rubber blanket cylinder and plate cylinder, and means forming an impression cylinder;

web deflection means for guiding the path of the web, located between adjacent printing stations and for compensating for different lengths of the web between said stations when the stations are operated in the said different modes; said web deflection means comprising:

a web deflection roller (10, 11; 51, 51, 62); means (12*a*, 13*a*, 24, 25, 53, 54, 55) for applying a positioning force on said roller operative to move the roller between predetermined defined positions (A, B), in which each predetermined position is associated one of the predetermined printing modes and a predetermined path length of the web through the stations of the machine;

presettable web tension control means (14–19, 20–23, 24, 25; 53–55) acting on the force applying means operative to apply a superimposed tensioning force on said roller, and hence on the web, to deflect the web by a distance which is small with respect to the distance between said predetermined positions and which is effective to control the tension of the web between adjacent stations as a function of predetermined operating parameters, including web path length arising upon printing in the selected mode; and adjustment control means coupled to and controlling said presettable web tension control means to permit repetitive preset application of the same tensioning force by said web deflection means on the web subsequent to interruption of printing operation of the printing machine system.

2. System according to claim 1, wherein said printing stations comprise serially arranged offset printing systems, and the means forming the impression cylinder comprises an offset rubber blanket cylinder paired with a plate cylinder; one printing mode comprising offset printing, and another printing mode comprising di-litho or flexo printing, the substrate web (5) being passed between the rubber blanket cylinders for offset operation along a first guide path, (A, A′, A″) and being positionable about a second guide path (B, B′, B″) about adjacent rubber blanket cylinders and between the associated respective plate cylinders for di-litho or flexo printing mode of operation.

3. System according to claim 1, wherein (FIG. 4) said means forming an impression printing cylinder comprises an impression cylinder (38), and the printing stations include paired rubber blanket cylinders and plate cylinders (39–43; 40–44; 41–45; 42–46) circumferentially positioned about the impression cylinder (38) at respective circumferentially offset angular positions thereof, and the path (A″) of the substrate web (5) for offset printing mode is about said central printing or impression cylinder and between the respective rubber blanket cylinders;

and for, respectively, di-litho or flexo printing, the path (8″) of the paper web is guided to pass between the respective rubber blanket cylinders (39, 40, 41, 42) and the associated respective plate (43, 44, 45, 46) of cylinders.

4. System according to claim 1, wherein the deflection means comprises a slide (12, 13; 47, 48, 49) on which said deflection roller (10, 11; 50, 51, 52) is positioned, and the positioning force applying means are engageable with said slide to move the deflection roller between predetermined selected base positions in accordance with the predetermined path and the predetermined printing mode.

5. System according to claim 4, wherein the force applying means comprises stepping motors (24, 25; 53, 54, 55).

6. System according to claim 4, wherein said tensioning force applying means comprises positioning piston-cylinder combinations (14, 15) acting on said deflecting roller;

and means controlling the extent of deflecting distance effected by said piston-cylinder combinations.

7. System according to claim 6, wherein said deflection distance controlling means comprises positioning means (16–19; 20–23) controlling the extent of movement of the piston-cylinder combination being applied to the deflecting roller (10, 11; 50,51, 52).

8. System according to claim 1, wherein (FIG. 6) the deflection means comprises support means (59) secured to the printing machine system;

said means for applying the positioning force to said deflection roller comprises a positioning motor (61), said positioning motor being controllable to move said deflection roller between said predetermined positions;

and being further controllable to apply said tension deflecting force by additional movement of distances which are small with respect to the distances between said predetermined position to provide for superimposition of the small further positioning movement and said movement between said predetermined positions by a single positioning motor.

9. System according to claim 8, wherein said positioning motor comprises a stepping motor (61);

and logic control means (62) connected to the stepping motor to cause the stepping motor to step a few steps for applying said further deflecting force on the surface of the web and to step through a number of steps which is large with respect to said few steps to move the deflecting roller between said predetermined positions.

* * * * *